US009158230B2

(12) United States Patent
Kubota

(10) Patent No.: US 9,158,230 B2
(45) Date of Patent: Oct. 13, 2015

(54) DEVELOPING DEVICE AND IMAGE FORMING APPARATUS USING THE SAME

(71) Applicant: SHARP KABUSHIKI KAISHA, Osaka-shi, Osaka (JP)

(72) Inventor: Hiroshi Kubota, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/537,500

(22) Filed: Nov. 10, 2014

(65) Prior Publication Data

US 2015/0198908 A1 Jul. 16, 2015

(30) Foreign Application Priority Data

Jan. 10, 2014 (JP) ..... 2014-003282

(51) Int. Cl.
*G03G 15/08* (2006.01)

(52) U.S. Cl.
CPC ..... *G03G 15/0812* (2013.01)

(58) Field of Classification Search
CPC ..... G03G 15/0812
See application file for complete search history.

(56) References Cited

U.S. PATENT DOCUMENTS 5,761,588 A * 6/1998 Mikawa et al. ..... 399/274
2008/0310888 A1* 12/2008 Do ..... 399/284
2013/0164043 A1* 6/2013 Watanabe ..... 399/269

FOREIGN PATENT DOCUMENTS

JP 7-219341 A 8/1995

* cited by examiner

*Primary Examiner* — Sandra Brase
(74) *Attorney, Agent, or Firm* — Birch, Stewart, Kolasch & Birch, LLP

(57) ABSTRACT

This invention is to provide a developing device uniformly developing an image along an axis line of a developing roller and stably obtaining the image with a uniform concentration. The developing device comprises: a developer tank, the developing roller, and a cylindrical layer thickness-regulating member. The layer thickness-regulating member comprises a body part regulating a layer thickness of a developer retained on an outer periphery of the developing roller; a first supporting part having a diameter smaller than that of the body part and supporting the body part at one end of the body part; and a second supporting part having a diameter smaller than or the same as that of the body part and supporting the body part at the other end of the body part. The first supporting part is provided such that a central axis of the first supporting part is configured to be eccentric to a central axis of the body part at a predetermined eccentricity ratio; therefore, the body part tentatively supported by the first supporting part and the second supporting part is appropriately rotated and adjusted to obtain a predetermined gap before the layer thickness-regulating member is fixedly supported by the developer tank.

18 Claims, 15 Drawing Sheets

DEVELOPING DEVICE AND IMAGE FORMING APPARATUS USING THE SAME

CROSS-REFERENCE TO RELATED APPLICATION

This application is related to Japanese Patent Application No. 2014-003282 filed on Jan. 10, 2014, whose priority is claimed under 35 USC §119, the disclosure of which is incorporated by reference in its entirety.

BACKGROUND OF THE INVENTION

1. Field of the Invention

This invention relates to a developing device and an image forming apparatus. More particularly, this invention relates to the developing device used in the electrophotographic image forming apparatus such as a copying machine or a printer to visualize an electrostatic latent image by allowing a developer to adhere to the electrostatic latent image on a photoconductive drum surface; and the image forming apparatus using this developing device.

2. Description of the Related Art

A conventional developing device has been known to comprise a developer tank containing a developer including a toner and a carrier; a developing roller disposed in this developer tank in such a way as to be opposed to a photoconductive drum, the developing roller retaining the developer on its outer periphery and supplying the toner included in the developer in the developer tank to the photoconductive drum; and a cylindrical layer thickness-regulating member disposed to be opposed to the outer periphery of the developing roller so as to be spaced at a predetermined gap from the outer periphery and regulating a layer thickness of the developer retained on the outer periphery of the developing roller.

The developer tank in the developing device comprising this type of the cylindrical layer thickness-regulating member is generally a cast resin article, and the cylindrical layer thickness-regulating member is mounted on a part of an end wall of the developer tank. Variations in cast dimension of the developer tank, therefore, could cause variations of the predetermined gap of the cylindrical layer thickness-regulating member.

In this case, the developing device is more difficult to uniformly develop an image along an axis line of the developing roller and to stably obtain the image with a uniform concentration than a developing device comprising a plate-like layer thickness-regulating member that is relatively easy to finely adjust a gap between the layer thickness-regulating member and an outer periphery of a developing roller.

Therefore, as an example in forming the uniform layer thickness of the developer on the developing roller along the axis line, the invention disclosed in Japanese Unexamined Patent Application Publication No. Hei 7 (1995)-219341 is proposed.

Japanese Unexamined Patent Application Publication No. Hei 7 (1995)-219341 discloses a developing device provided with a layer thickness-regulating roller disposed on the upstream side of a rotating direction of a developing roller from a developing area and supported in such a way as to come in contact with the developing roller, and the layer thickness-regulating roller has grooves extending in a circumferential direction on an outer periphery of the layer thickness-regulating roller and approximately equally spaced along an axis line of the layer thickness-regulating roller.

However, even the developing device disclosed in Japanese Unexamined Patent Application Publication No. Hei 7 (1995)-219341 could not have completely avoided consequences arisen from mounting errors or deflections of the developing roller or the layer thickness-regulating roller and was difficult to obtain an image stably.

SUMMARY OF THE INVENTION

In view of these circumstances, this invention has an object of providing a developing device, despite its simple structure, configured to uniformly develop an image along an axis line of a developing roller and to stably obtain the image with a uniform concentration; and an image forming apparatus for carrying out excellent image formation with use of this developing device.

A first aspect of this invention provides a developing device comprising a developer tank containing a developer; a developing roller disposed in the developer tank in such a way as to be opposed to a photoconductive drum, the developing roller retaining the developer on its outer periphery and supplying a toner included in the developer to a surface of the photoconductive drum; and a cylindrical layer thickness-regulating member fixedly supported by the developer tank in such a way as to be opposed to the outer periphery of the developing roller and to be spaced at a predetermined gap from the outer periphery and regulating a layer thickness of the developer in the form of a layer retained on the outer periphery of the developing roller, wherein the layer thickness-regulating member comprises a body part provided along an axis line of the developing roller and regulating the layer thickness; a first supporting part having a diameter smaller than that of the body part and provided at one end of the body part to project from the body part and parallel to the body part so as to support the body part at the one end; and a second supporting part having a diameter smaller than or the same as that of the body part and provided at the other end of the body part to project from the body part and parallel to the body part so as to support the body part at the other end, wherein the first supporting part of the layer thickness-regulating member is provided such that a central axis of the first supporting part is configured to be eccentric to a central axis of the body part at a predetermined eccentricity ratio and that the body part tentatively supported by the first supporting part and the second supporting part is appropriately rotated and adjusted by a person (who assembles the developing device) to obtain the predetermined gap before the layer thickness-regulating member is fixedly supported by the developer tank.

A second aspect of this invention provides an image forming apparatus incorporating the developing device therein provided by the first aspect.

In the developing device provided by the first aspect of this invention, the cylindrical layer thickness-regulating member is fixedly supported by the developer tank in such a way as to be opposed to the outer periphery of the developing roller and to be spaced at the predetermined gap from the outer periphery and regulates the layer thickness of the developer retained in layer on the outer periphery of the developing roller.

The layer thickness-regulating member comprises the body part provided along the axis line of the developing roller and regulating the layer thickness; the first supporting part having a diameter smaller than that of the body part and provided at the one end of the body part to project from the body part and parallel to the body part so as to support the body part at the one end; and the second supporting part having a diameter smaller than or the same as that of the body part and provided at the other end of the body part to project from the body part and parallel to the body part so as to support the body part at the other end.

The first supporting part of the layer thickness-regulating member is provided such that the central axis of the first supporting part is configured to be eccentric to the central axis of the body part at a predetermined eccentricity ratio. The body part tentatively supported by the first supporting part and the second supporting part is appropriately rotated and adjusted by a person before the layer thickness-regulating member is fixedly supported by the developer tank so that the gap between the body part of the layer thickness-regulating member and the outer periphery of the developing roller is measured at a certain position with use of a gap-measuring instrument such as a gap gauge every time the body part is rotated and adjusted. As a result, the predetermined gap can be obtained—the gap used for uniformly developing the image along the axis line of the developing roller and for stably obtaining the image with a uniform concentration.

In the developing device of this invention, therefore, the layer thickness-regulating member is fixedly supported by the developer tank in such a way as to be opposed to the outer periphery of the developing roller and to be spaced from the outer periphery at the predetermined gap so that the image can be uniformly developed along the axis line of the developing roller; and the image with the uniform concentration can be stably obtained.

The image forming apparatus provided by the second aspect incorporates the developing device therein provided by the first aspect. As described above, the developing device provided by the first aspect is capable of uniformly developing the image along the axis line of the developing roller to obtain the image with the uniform concentration. Therefore, the image forming apparatus provided by the second aspect of this invention is capable of carrying out excellent image formation with use of the developing device provided by the first aspect.

In the following, preferred embodiments of the developing device provided by the first aspect and of the image forming apparatus provided by the second aspect will be explained.

(1) The body part of the layer thickness-regulating member in the developing device provided by the first aspect may be formed in such a way as to have the same outside diameter throughout its entire length.

It is easy to form the cylindrical body part by carrying out a desired machining in such a way as to have the same outside diameter throughout its entire length. It is also easy to carry out operations such that the body part tentatively supported by the first supporting part and the second supporting part is appropriately rotated and adjusted by a person before the layer thickness-regulating member is fixedly supported by the developer tank and that the gap between the body part and the outer periphery of the developing roller is measured at a certain position.

(2) The body part of the layer thickness-regulating member may be formed in such a way as to be conically tapered from one end to the other end of the body part. The body part conically tapered from the one end to the other end is capable of adjusting a gap between the body part and the outer periphery of the developing roller throughout an entire length of the body part more finely than the body part having the same outside diameter throughout its entire length.

The conical taper may be in the form of a right conical taper forming a right circular truncated cone or in the form of an oblique conical taper forming an oblique circular truncated cone.

(3) The body part of the layer thickness-regulating member may have a flat surface portion formed on its outer periphery, and the flat surface portion has a rectangular shape in plan configuration extending throughout an entire length of the body part in a longitudinal direction. A cross-section surface of the body part having this flat surface portion has the shape like the letter D.

The body part having the flat surface portion formed on its outer periphery—the flat surface portion has the rectangular shape in plan configuration and extends throughout the entire length of the body part in the longitudinal direction—has the cross-section surface with the shape like the letter D throughout the entire length of the body part and is capable of adjusting the gap between the body part and the outer periphery of the developing roller throughout the entire length of the body part more finely than the body part having the same outside diameter throughout its entire length.

(4) The central axis of the first supporting part of the layer thickness-regulating member is configured to be eccentric to the central axis of the body part at a predetermined eccentricity ratio. The eccentricity ratio in this specification and in claims means a ratio indicating how much the central axis of the first supporting part is eccentric to the central axis of the body part. An eccentricity ratio of 5/100, for example, indicates that the central axis of the first supporting part is eccentric to the central axis of the body part by 5 length unit, provided that the outside diameter of the body part is considered to be 100 length unit.

It is preferable that this eccentricity ratio ranges from 2/100 to 10/100. In the case where the eccentricity ratio is less than 2/100, the above-described effects would not appear notably such that an image is uniformly developed along the axis line of the developing roller and that the uniform concentration of the image is obtained stably, whereas in the case where the eccentricity ratio is more than 10/100, the above-described operation would not be carried out easily such that the gap between the body part and the outer periphery of the developing roller is measured.

(5) The image forming apparatus provided by the second aspect may incorporate any one of the constructions (1) to (4) above of the developing device provided by the first aspect. The image forming apparatus provided by the second aspect is capable of carrying out the excellent image formation with use of any one of the constructions above of the developing device because the developing device having any one of the constructions above is capable of uniformly developing the image along the axis line of the developing roller and of stably obtaining the image with the uniform concentration.

DESCRIPTION OF THE PREFERRED EMBODIMENTS

In the following, Embodiments 1 to 5 of this invention will be explained through the use of the drawings.

Embodiment 1

Figure 1:
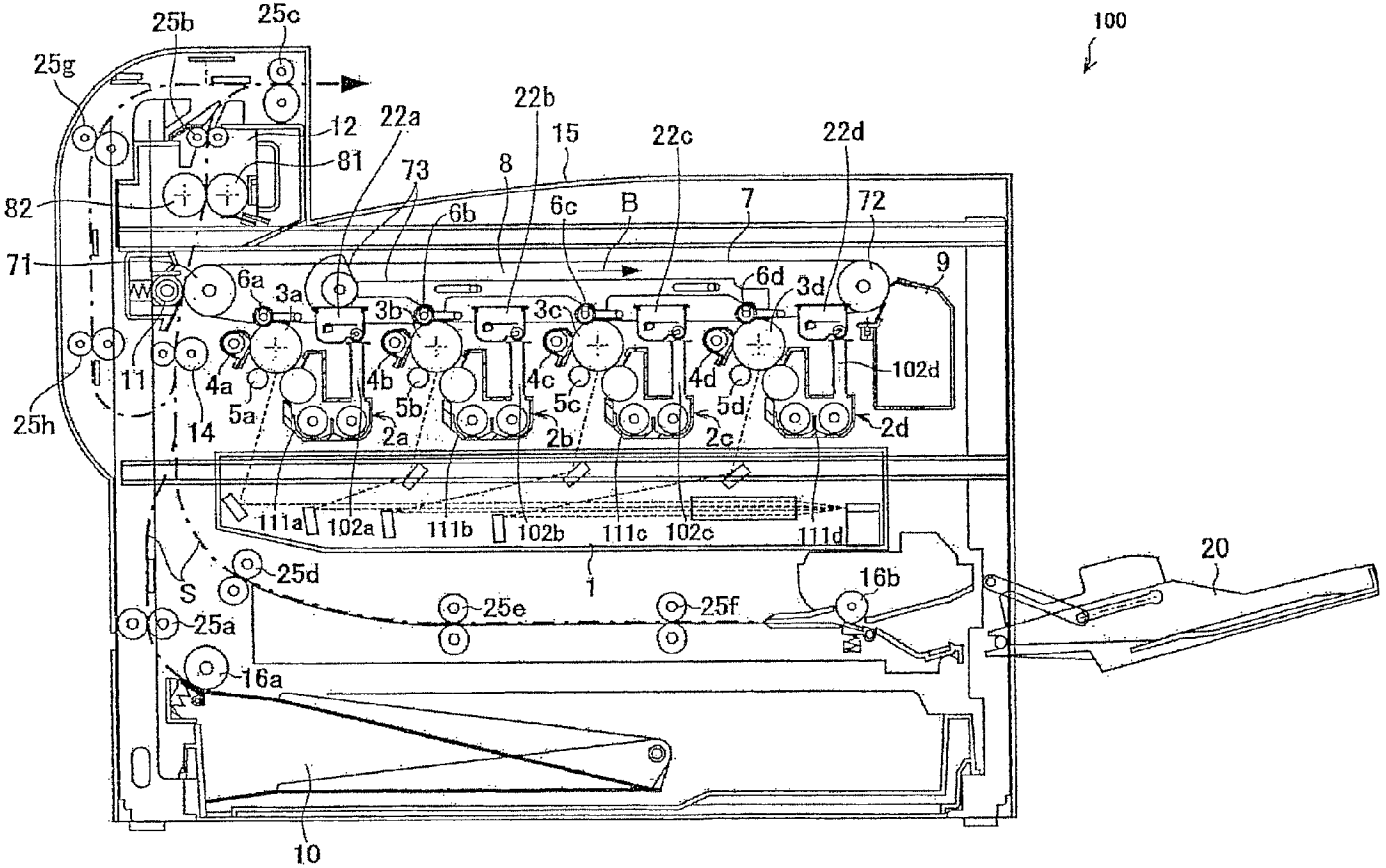
FIG. 1 is an explanatory view of an overall construction of an image forming apparatus incorporating a developing device according to Embodiment 1 of this invention.

FIG. 1 is an explanatory view of an overall construction of an image forming apparatus incorporating a developing device according to Embodiment 1 of this invention. In FIG. 1, a reference numeral 100 indicates an image forming apparatus that forms an image with use of a toner by adopting an electrophotographic system.

The image forming apparatus 100 comprises a photoconductive drum 3 where an electrostatic latent image is formed on its surface; a charger (charging device) 5 charging the surface of the photoconductive drum 3; an exposure unit (exposure device) 1 forming an electrostatic latent image on the surface of the photoconductive drum 3; a developing device 2 supplying a toner to the electrostatic latent image on the surface of the photoconductive drum 3 to form a toner image; a toner refill device 22 refilling the developing device 2 with a toner; an intermediate transfer belt unit (transfer device) 8 transferring the toner image on the surface of the photoconductive drum 3 onto a recording medium; and a fuser unit (fusing device) 12 fusing the toner image on the recording medium.

The image forming apparatus 100 is to form a multi-color or single color image on a prescribed sheet (recording sheet or recording medium) on the basis of image data fed from an outside source. The image forming apparatus 100 may be provided on the upper side with a scanner, etc.

An overall construction of the image forming apparatus 100 will be explained. As illustrated in FIG. 1, the image forming apparatus 100 is configured to manage image data with use of color components—black (K), cyan (C), magenta (M), and yellow (Y)—and thereby to form a black image, a cyan image, a magenta image, and a yellow image; and the image forming apparatus is configured to form a color image by superimposing the black image, the cyan image, the magenta image, and the yellow image using the color components.

Therefore, as illustrated in FIG. 1, the image forming apparatus 100 is provided with four components of the following members each: the developing device 2 (2*a*, 2*b*, 2*c*, 2*d*), the photoconductive drum 3 (3*a*, 3*b*, 3*c*, 3*d*), the charger 5 (5*a*, 5*b*, 5*c*, 5*d*), and a cleaner unit 4 (4*a*, 4*b*, 4*c*, 4*d*) so as to form the black image, the cyan image, the magenta image, and the yellow image.

In other words, the image forming apparatus is provided with four image forming stations (image forming part), each of the image forming stations comprises one developing device 2, one photoconductive drum 3, one charger 5, and one cleaner unit 4.

The above-described reference numerals a to d indicate that a indicates the components to be used for forming the black image, b indicates the components to be used for forming the cyan image, c indicates the components to be used for forming the magenta image, and d indicates the components to be used for forming the yellow image.

The image forming apparatus 100 also comprises a sheet-conveying path S, a paper feed tray 10, a copy-receiving tray 15, and a manual sheet-feeding tray 20.

The charger 5 is to evenly charge the surface of the photoconductive drum 3 at a prescribed electric potential. Usable as the charger 5 is a contact roller-type charger (see FIG. 1), a contact brush-type charger, a non-contact charger, or the like.

As illustrated in FIG. 1, the exposure unit 1 is a laser scanning unit (LSU) comprising a laser irradiation part and a reflection mirror. Instead of the laser scanning unit, usable as the exposure unit 1 is EL (electroluminescence) having an array with light-emitting elements or a writing head using LED.

The exposure unit 1 exposes the charged photoconductive drum 3 to light on the basis of the fed image data so as to form the electrostatic latent image on the surface of the photoconductive drum 3 on the basis of the image data.

The developing device 2 is to visualize (develop) the electrostatic latent image formed on the photoconductive drum 3 with use of any of the toners K, C, M, and Y. The developing device 2 (2*a*, 2*b*, 2*c*, 2*d*) comprises the toner refill device 22 (22*a*, 22*b*, 22*c*, 22*d*), a toner transport mechanism 102 (102*a*, 102*b*, 102*c*, 102*d*), and a developer tank (developer container) 111 (111*a*, 111*b*, 111*c*, 111*d*).

The toner refill device 22 is disposed higher than the developer tank 111 and store an unused toner (powder toner). The toner refill device 22 is configured to supply the toner to the developer tank 111 through the toner transport mechanism 102.

The cleaner unit 4 is to remove and collect the toner left on the surface of the photoconductive drum 3 after the steps of developing the image and of transferring the image are completed.

The intermediate transfer belt unit 8 is disposed above the photoconductive drum 3. The intermediate transfer belt unit 8 comprises an intermediate transfer roller 6 (6*a*, 6*b*, 6*c*, 6*d*), an intermediate transfer belt 7, an intermediate transfer belt-driving roller 71, an intermediate transfer belt-driven roller 72, an intermediate transfer belt tension mechanism 73, and an intermediate transfer belt-cleaning unit 9.

The intermediate transfer roller 6, the intermediate transfer belt-driving roller 71, the intermediate transfer belt-driven roller 72, and the intermediate transfer belt tension mechanism 73 tension the intermediate transfer belt 7 and rotate the intermediate transfer belt 7 in a direction indicated by an arrow B in FIG. 1. The intermediate transfer roller 6 is rotatably supported by an intermediate transfer roller-mounting part provided at the intermediate transfer belt tension mechanism 73 of the intermediate transfer belt unit 8. A transfer bias is applied to the intermediate transfer roller 6 so that the toner image on the photoconductive drum 3 is transferred to the intermediate transfer belt 7.

The intermediate transfer belt 7 is configured to come in contact with each of the photoconductive drums 3*a*, 3*b*, 3*c*, and 3*d*. The toner images—the black image, the cyan image, the magenta image, and the yellow image—formed on the photoconductive drums 3*a*, 3*b*, 3*c*, and 3*d*, respectively, are transferred and superimposed on the intermediate transfer belt 7 in sequence so that a color toner image (multi-color toner image) is formed. The intermediate transfer belt 7 is provided in the form of an endless belt with use of a film having a thickness, for example, on the order of 100 μm to 150 μm.

The toner images are transferred from the photoconductive drums 3*a*, 3*b*, 3*c*, and 3*d* to the intermediate transfer belt 7 by means of the intermediate transfer roller 6 coming in contact with the back side of the intermediate transfer belt 7. To transfer the toner images, the high-voltage transfer bias (a high voltage with a polarity (+) opposite to a charging polarity (−) of the toners) is applied to the intermediate transfer roller 6.

The intermediate transfer roller 6 is formed in the form of a metal shaft (for example, stainless steel) having a diameter of, for example, 8 to 10 mm and is covered with a conductive elastic material (for example, EPDM or urethane foam). Because of this conductive elastic material, the high voltage can be evenly applied to the intermediate transfer belt 7 from the intermediate transfer roller 6.

In Embodiment 1, used as a transfer electrode is a roller-type electrode (the intermediate transfer roller 6); however, a brush or the like is also usable.

As described above, the electrostatic latent images on the photoconductive drums 3*a*, 3*b*, 3*c*, and 3*d* are visualized by the toners corresponding to the color components so as to form the toner images, respectively; and these toner images are superimposed and laminated on the intermediate transfer belt 7. The laminated toner images are displaced by the rotating intermediate transfer belt 7 to a contact location (transferring part) between a sheet conveyed and the intermediate transfer belt 7 and are transferred onto the sheet by a transfer roller 11 disposed at this location.

In this case, the intermediate transfer belt 7 and the transfer roller 11 are pressed into contact with each other by a given nip; and a voltage for transferring the toner images onto the sheet is applied to the transfer roller 11. This voltage is the high voltage with the polarity (+) opposite to the charging polarity (−) of the toners.

To obtain the nip steadily, one of the transfer roller 11 and the intermediate transfer belt-driving roller 71 is made of a hard material such as metal; and the other one is made of a soft material such as an elastic rubber or a foamable resin.

The following two kinds of the toners are removed and collected by the intermediate transfer belt-cleaning unit 9 so that these toners would not be mixed with each other in the next stage: the toners that adhere to the intermediate transfer belt 7 because of the contact between the intermediate transfer belt 7 and the photoconductive drum 3; and the toners that are left on the intermediate transfer belt 7 because these toners are not transferred at the time of transferring the toner images from the intermediate transfer belt 7 onto the sheet.

The intermediate transfer belt-cleaning unit 9 comprises a cleaning blade (cleaning member) coming in contact with the intermediate transfer belt 7. A part of the intermediate transfer belt 7 coming in contact with the cleaning blade is supported by the intermediate transfer belt-driven roller 72 from the back side of the intermediate transfer belt.

The paper feed tray 10 is to contain sheets (for example, recording sheets) to be used for image formation and is provided under an image-forming part and the exposure unit 1. The copy-receiving tray 15 is to receive and contain printed/copied sheets face-down and is provided above the image forming apparatus 100.

The image forming apparatus 100 is also provided with the sheet-conveying path S for conveying sheets on the paper feed tray 10 and sheets on the manual sheet-feeding tray 20 to the copy-receiving tray 15 via the transferring part and the fuser unit 12. The transferring part is positioned between the intermediate transfer belt-driving roller 71 and the transfer roller 11.

Disposed along the sheet-conveying path S are a pickup roller 16 (16*a*, 16*b*), a registering roller 14, the transferring part, the fuser unit 12, a conveying roller 25 (25*a* to 25*h*), etc.

The plurality of conveying rollers 25*a* to 25*h* are small rollers for facilitating and assisting the sheets to be conveyed and are provided along the sheet-conveying path S. The pickup roller 16*a* is disposed at an end of the paper feed tray 10 and functions as a sheet-drawing roller supplying the sheets one by one from the paper feed tray 10 to the sheet-conveying path S. The pickup roller 16*b* is disposed near the manual sheet-feeding tray 20 and functions as a sheet-drawing roller supplying the sheets one by one from the manual sheet-feeding tray 20 to the sheet-conveying path S.

The registering roller 14 is to temporarily keep a sheet conveyed through the sheet-conveying path S and to convey the sheet to the transferring part at a time when front edges of the toner images on the intermediate transfer belt 7 register with a front edge of the sheet.

The fuser unit 12 comprises a heating roller 81, a pressure roller 82, etc.; and the heating roller 81 and the pressure roller 82 catch a sheet therebetween and rotate. The heating roller 81 is controlled by a controller (not illustrated) to keep a predetermined fusing temperature. This controller controls the temperature of the heating roller 81 on the basis of a detection signal sent from a temperature detector (not illustrated).

The heating roller 81 subjects the sheet to thermocompression-bonding with use of the pressure roller 82 so that the toner images transferred onto the sheet—the black image, the cyan image, the magenta image, and the yellow image—are melted, mixed, and pressed into contact with the sheet to be heat-fused on the sheet. The sheet with the multi-color toner image (formed with the toner images—the black image, the cyan image, the magenta image, and the yellow image) is conveyed to a reverse sheet-discharging path within the sheet-conveying path S by means of the conveying rollers 25*a* to 25*h* so that the sheet is reversed (the multi-color toner image lies face-down) and discharged onto the copy-receiving tray 15.

Sheet-conveying operations of the sheet-conveying path S will be explained below.

As illustrated in FIG. 1, the image forming apparatus 100 comprises the above-described paper feed tray 10 containing sheets beforehand and the above-described manual sheet-feeding tray 20 to be used, for example, in the case where only a few sheets are printed. The tray 10 is provided with the pickup roller 16*a*, whereas the tray 20 is provided with the pickup roller 16*b*; and the pickup rollers 16*a* and 16*b* are configured to supply the sheets one by one to the sheet-conveying path S.

In the case of one-side printing, a sheet conveyed from the paper feed tray 10 is conveyed to the registering roller 14 by the conveying roller 25*a* disposed at the sheet-conveying path S and is conveyed to the transferring part (a contact location between the transfer roller 11 and the intermediate transfer belt 7) by the registering roller 14 at a time when a front edge of the sheet regists with front edges of the toner images laminated on the intermediate transfer belt 7. The toner images are transferred onto the sheet at the transferring part and are fused on the sheet by the fuser unit 12. After this process, the sheet is conveyed by the conveying roller 25*b* and then the sheet-discharging roller (the conveying roller) 25*c* and is discharged onto the copy-receiving tray 15.

A sheet conveyed from the manual sheet-feeding tray 20 is conveyed by the conveying rollers 25*f*, 25*e*, and 25*d* to the registering roller 14. Then, the sheet is conveyed and discharged to the copy-receiving tray 15 in the same way as the sheet supplied from the paper feed tray 10 by means of the sheet-conveying operation.

In the case of both-side printing, a rear end of the one-side printed sheet passed through the fuser unit 12 as described above is chucked by the sheet-discharging roller 25*c*. The sheet-discharging roller 25*c* then rotates backward and conveys the sheet to the conveying rollers 25*g* and 25*h*, and the sheet passes through the registering roller 14 again and is printed on its back side before being discharged to the copy-receiving tray 15.

Figure 2:
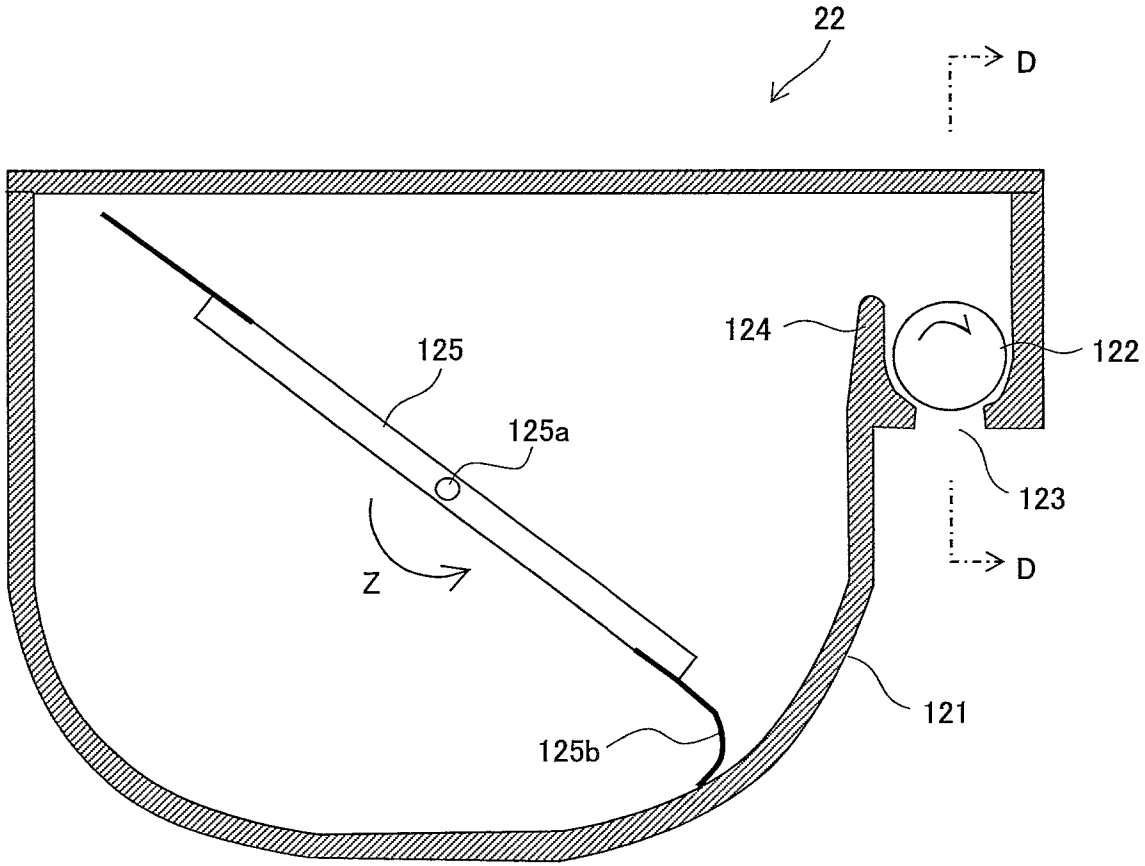
FIG. 2 is a cross-section view of a general construction of a toner refill device to construct the image forming apparatus of FIG. 1.

A construction of the toner refill device 22 will be specifically explained below. FIG. 2 is a cross-section view of a general construction of a toner refill device; and FIG. 3 is a cross-section view of the toner refill device illustrated in FIG. 2, taken along arrows D-D in FIG. 2.

Figure 3:
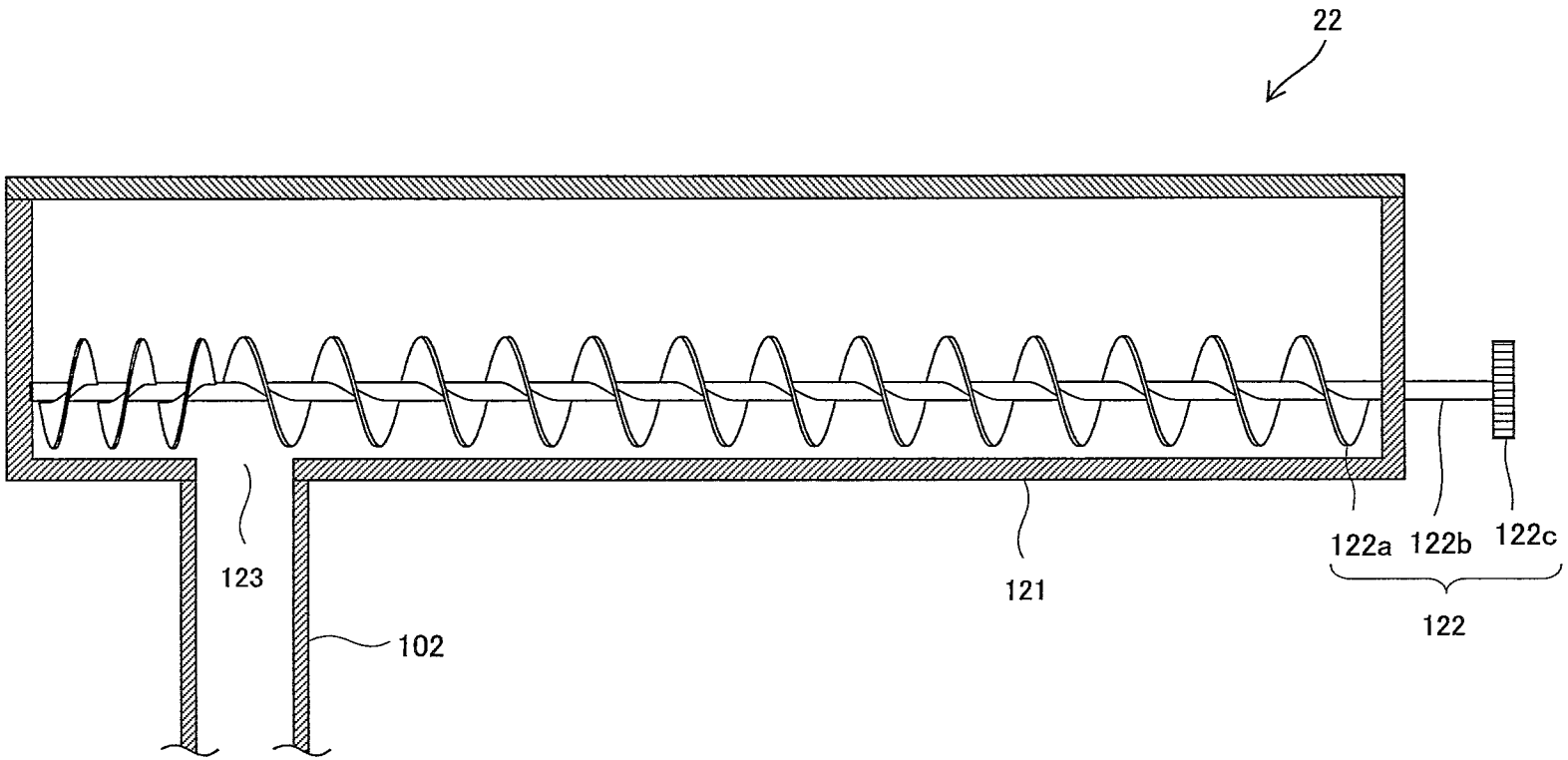
FIG. 3 is a cross-section view of the toner refill device illustrated in FIG. 2, taken along arrows D-D in FIG. 2.

As illustrated in FIGS. 2 and 3, the toner refill device 22 comprises a toner-storing container 121; a toner-stirring member 125; a toner discharge member 122; and a toner-discharging port 123. The toner refill devices 22*a* to 22*d* are disposed above the developer tank 111 and store unused toners (powder toners), respectively. A toner in the toner refill device 22 is supplied to the developer tank 111 through the toner-discharging port 123 and the toner transport mechanism 102 by rotating the toner discharge member (discharge screw) 122.

The toner-storing container 121 is a containing member having a hollow therein in the form of a semicircular cylinder to store a toner and rotatably supports the toner-stirring member 125 and the toner discharge member 122. The toner-discharging port 123 is an opening in the form of an approximate rectangle disposed under the toner discharge member 122, and the toner-discharging port 123 is provided in such a way as to be biased toward a center part of a shaft of the toner discharge member and faces toward the toner transport mechanism 102.

The toner-stirring member 125 rotates on a rotation axis 125*a* to stir the toner stored in the toner-storing container 121. The toner-stirring member 125 is a plate-like member for drawing up and conveying the toner in the toner-storing container 121 and is provided with a toner-drawing up member 125*b* at each end. The toner-drawing up member 125*b* is formed of a flexible polyethylene terephthalate (PET) sheet and is attached to each end of the toner-stirring member 125.

The toner discharge member 122 is to supply the toner in the toner-storing container 121 to the developer tank 111 through the toner-discharging port 123. The toner discharge member 122 comprises an auger screw including a toner-conveying blade 122*a* and a toner discharge member-rotating shaft 122*b*, and a toner discharge member-rotating gear 122*c* (see FIG. 3).

The toner discharge member 122 is configured to be driven by a toner discharge member-driving motor (not illustrated) so as to rotate. The auger screw is oriented to direct in such a way as to convey the toner toward the toner-discharging port 123 from both ends of the toner discharge member 122.

Provided between the toner discharge member 122 and the toner-stirring member 125 is a toner discharge member-partitioning wall 124. The toner discharge member-partitioning wall 124 allows a periphery of the toner discharge member 122 to keep a proper amount of the toner drawn up by the toner-stirring member 125.

As illustrated in FIG. 2, the toner-stirring member 125 rotates in a direction indicated by an arrow Z and stirs the toner to draw up the toner toward the toner discharge member 122. In this case, the toner-drawing up member 125*b* rotates as sliding on an inner wall of the toner-storing container 121 and changing its shape because of its flexibility in order to supply the toner to the toner discharge member 122. Thus, the rotating toner discharge member 122 conveys the toner to the toner-discharging port 123.

Figure 4:
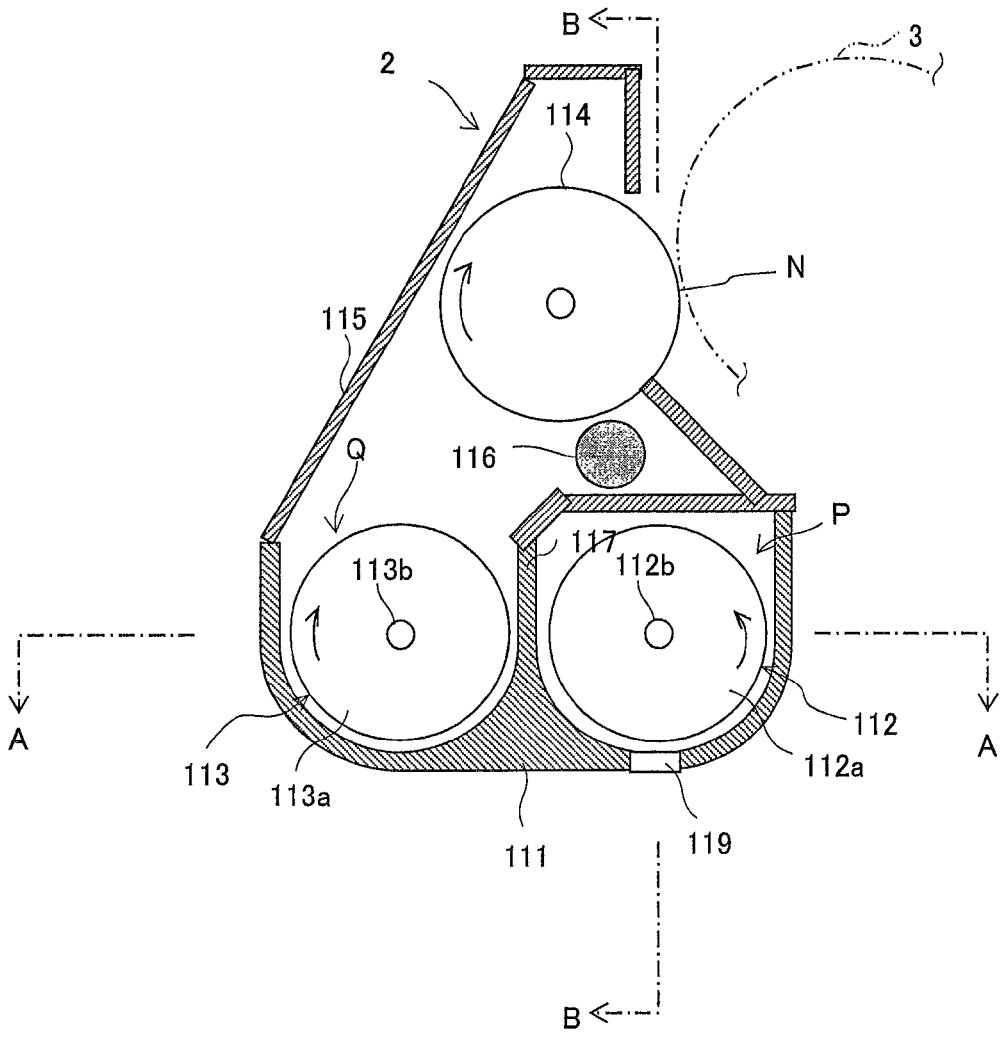
FIG. 4 is a cross-section view of a general construction of the developing device according to Embodiment 1.
Figure 5:
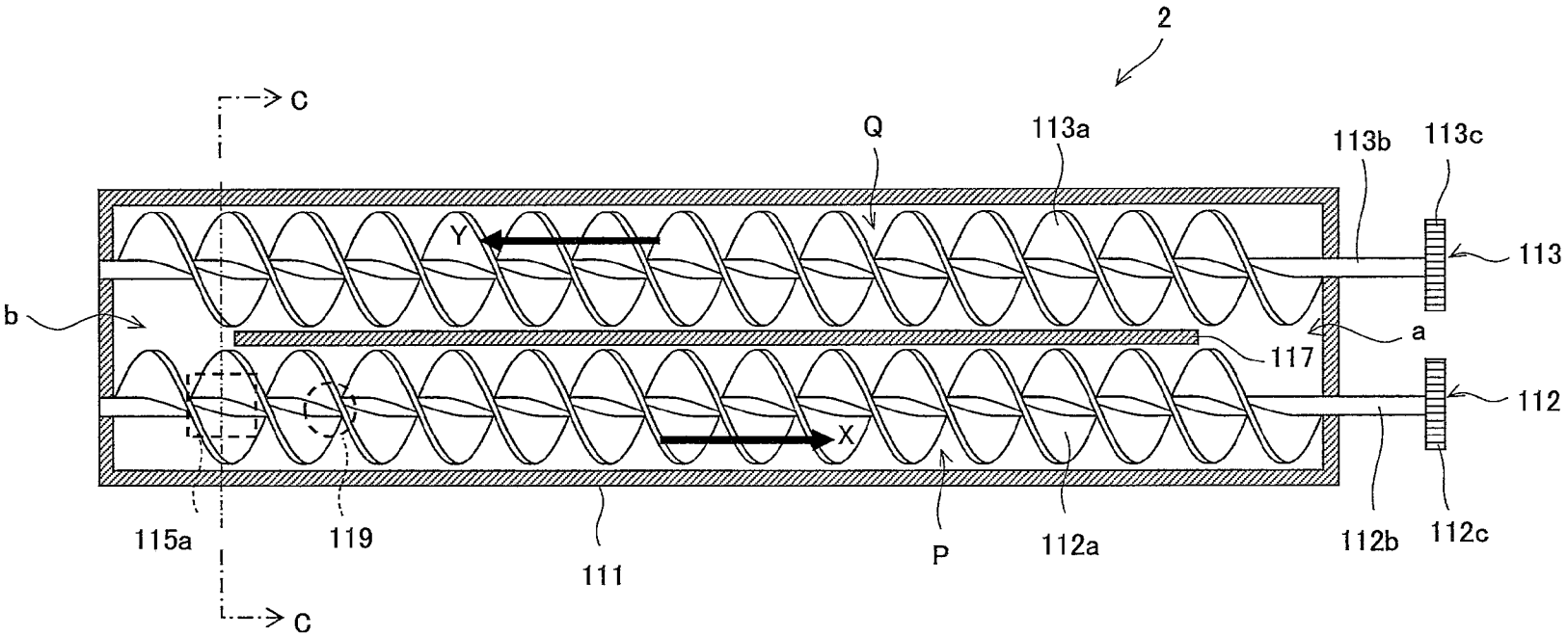
FIG. 5 is a cross-section view of the developing device illustrated in FIG. 4, taken along arrows A-A in FIG. 4.
Figure 6:
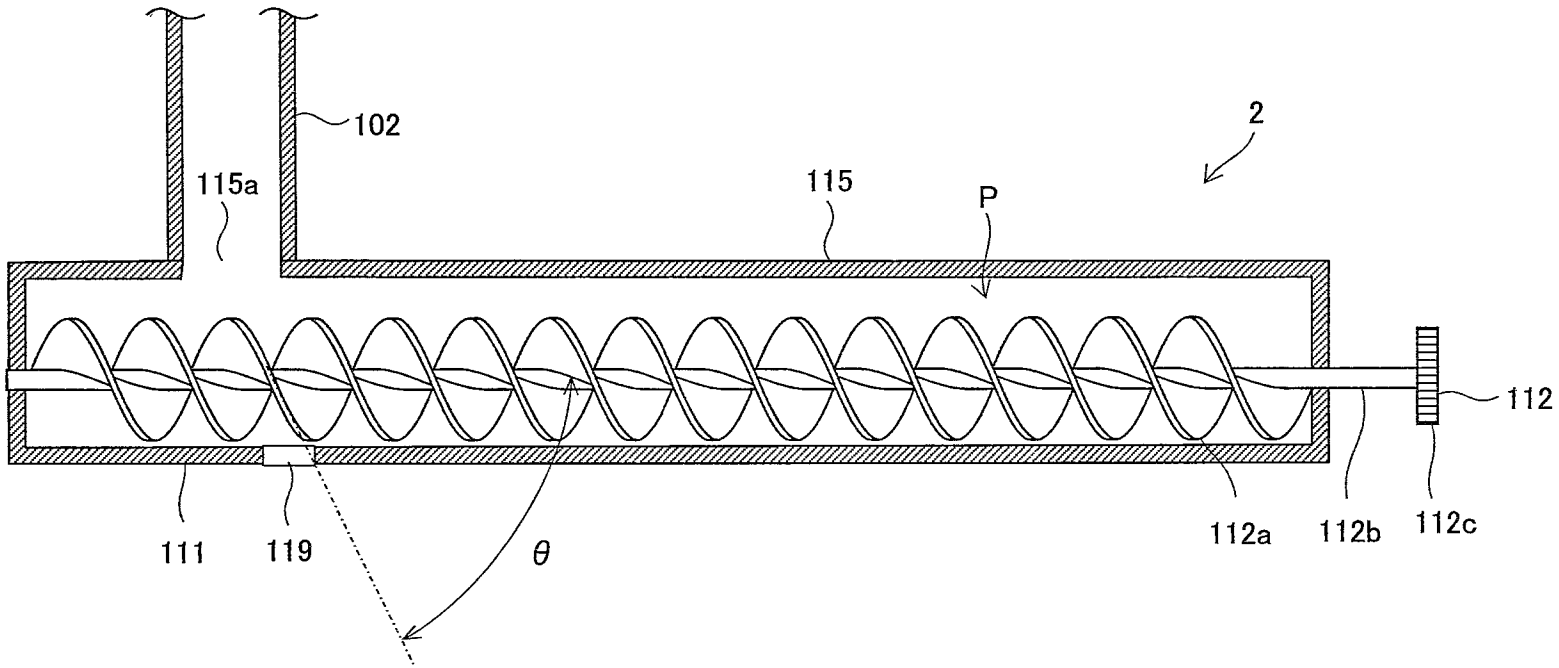
FIG. 6 is a cross-section view of the developing device illustrated in FIG. 4, taken along arrows B-B in FIG. 4.
Figure 7:
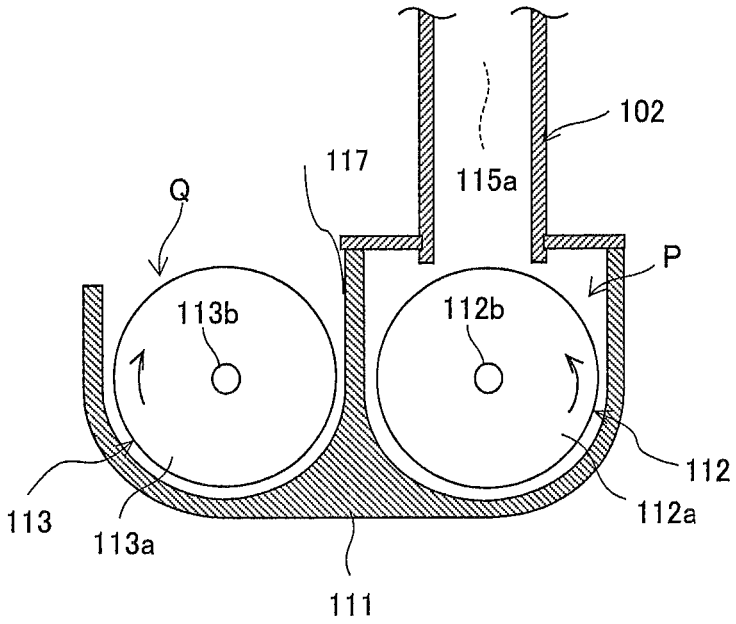
FIG. 7 is a cross-section view of the developing device illustrated in FIG. 5, taken along arrows C-C in FIG. 5.

FIG. 4 is a cross-section view of a general construction of the developing device according to Embodiment 1; FIG. 5 is a cross-section view of the developing device illustrated in FIG. 4, taken along arrows A-A in FIG. 4; FIG. 6 is a cross-section view of the developing device illustrated in FIG. 4, taken along arrows B-B in FIG. 4; and FIG. 7 is a cross-section view of the developing device illustrated in FIG. 5, taken along arrows C-C in FIG. 5.

A characteristic developing device 2 according to Embodiment 1 will be explained with reference to the drawings. As illustrated in FIG. 4, the developing device 2 comprises a developing roller (developer-retaining member) 114 disposed inside the developer tank 111 in such a way as to be opposed to the photoconductive drum 3. The developing roller 114 supplies the toner to the surface of the photoconductive drum 3 so as to visualize (develop) the electrostatic latent image formed on the surface of the photoconductive drum 3.

As illustrated in FIGS. 4 to 7, the developing device 2 comprises the developer tank 111, a developer tank cover 115, a toner refill port 115*a*, a doctor member 116, a first conveying member 112, a second conveying member 113, a partitioning plate (partitioning wall) 117, and a toner refill-detecting sensor 119 in addition to the developing roller 114.

The developer tank 111 is to store a two-component developer (hereafter referred to simply as "developer")—the components are a toner and a carrier. The developer tank 111 is provided with the developing roller 114, the first conveying member 112, the second conveying member 113, etc. The carrier used in this case is a magnetic carrier having magnetic properties.

As illustrated in FIGS. 4 and 6, the developer tank 111 is provided at its upper side with the detachable developer tank cover 115. The developer tank cover 115 has the toner refill port 115*a* for refilling the developer tank 111 with an unused toner.

The developer tank 111 has the partitioning plate 117 disposed between the first conveying member 112 and the second conveying member 113. The partitioning plate 117 is extended parallel to shafts (rotating shafts) of the first conveying member 112 and of the second conveying member 113. The partitioning plate 117 partitions the developer tank 111 into a first conveying path P provided with the first conveying member 112 and a second conveying path Q provided with the second conveying member 113.

The partitioning plate 117 is disposed whose both ends are away from inner wall end surfaces of the developer tank 111, respectively, where both ends of the shafts of the first conveying member 112 and of the second conveying member 113 are located so as to separate the inner wall end surfaces from the both ends of the partitioning plate 117, respectively. Because of this structure, the developer tank 111 has communicating paths communicating the first conveying path P with the second conveying path Q in the vicinity of the both ends of the shafts of the first conveying member 112 and of the second conveying member 113.

As illustrated in FIG. 5, the communicating path formed at the side of a direction indicated by an arrow X is hereafter referred to as "a first communicating path a"; and the communicating path formed at the side of a direction indicated by an arrow Y is hereafter referred to as "a second communicating path b."

The first conveying member 112 and the second conveying member 113 are configured to be disposed in such a way that peripheral surfaces of the first conveying member 112 and of the second conveying member 113 face each other across the partitioning plate 117 and that the shafts of the first conveying member 112 and of the second conveying member 113 are parallel to each other, and the first conveying member 112 and the second conveying member 113 are configured to rotate in opposite directions.

As illustrated in FIG. 5, the first conveying member 112 is configured to convey the two components-including developer in the direction X; and the second conveying member 113 is configured to convey the developer in the direction Y opposite from the direction X.

As illustrated in FIG. 5, the first conveying member 112 comprises an auger screw including a first conveying blade 112*a* in the form of a spiral and a first rotating shaft 112*b*; and a gear 112*c*. As also illustrated in FIG. 5, the second conveying member 113 comprises an auger screw including a second conveying blade 113*a* in the form of a spiral and a second rotating shaft 113*b*, and a gear 113*c*.

The first conveying member 112 and the second conveying member 113 are configured to be driven by driving means (not illustrated) such as motors, respectively, so as to rotate and stir to convey the developer.

The developing roller 114 is a magnet roller rotating on a shaft driven by a driving means (not illustrated), and the developing roller is to draw up the developer in the developer tank 111 and to retain the developer on a surface of the developing roller so as to supply the toner included in the developer on the developing roller surface to the photoconductive drum 3.

The developer to be conveyed by the developing roller 114 comes in contact with the photoconductive drum 3 at a part of the developing roller closest to the photoconductive drum 3. This contact area is indicated by a developing nip part N; and a developing bias voltage is applied, at the developing nip part N, from a power source (not illustrated) to be connected to the developing roller 114 to the developing roller 114. As a result, the toner included in the developer on the surface of the developing roller 114 is supplied to the electrostatic latent image on the surface of the photoconductive drum 3.

Figure 8:
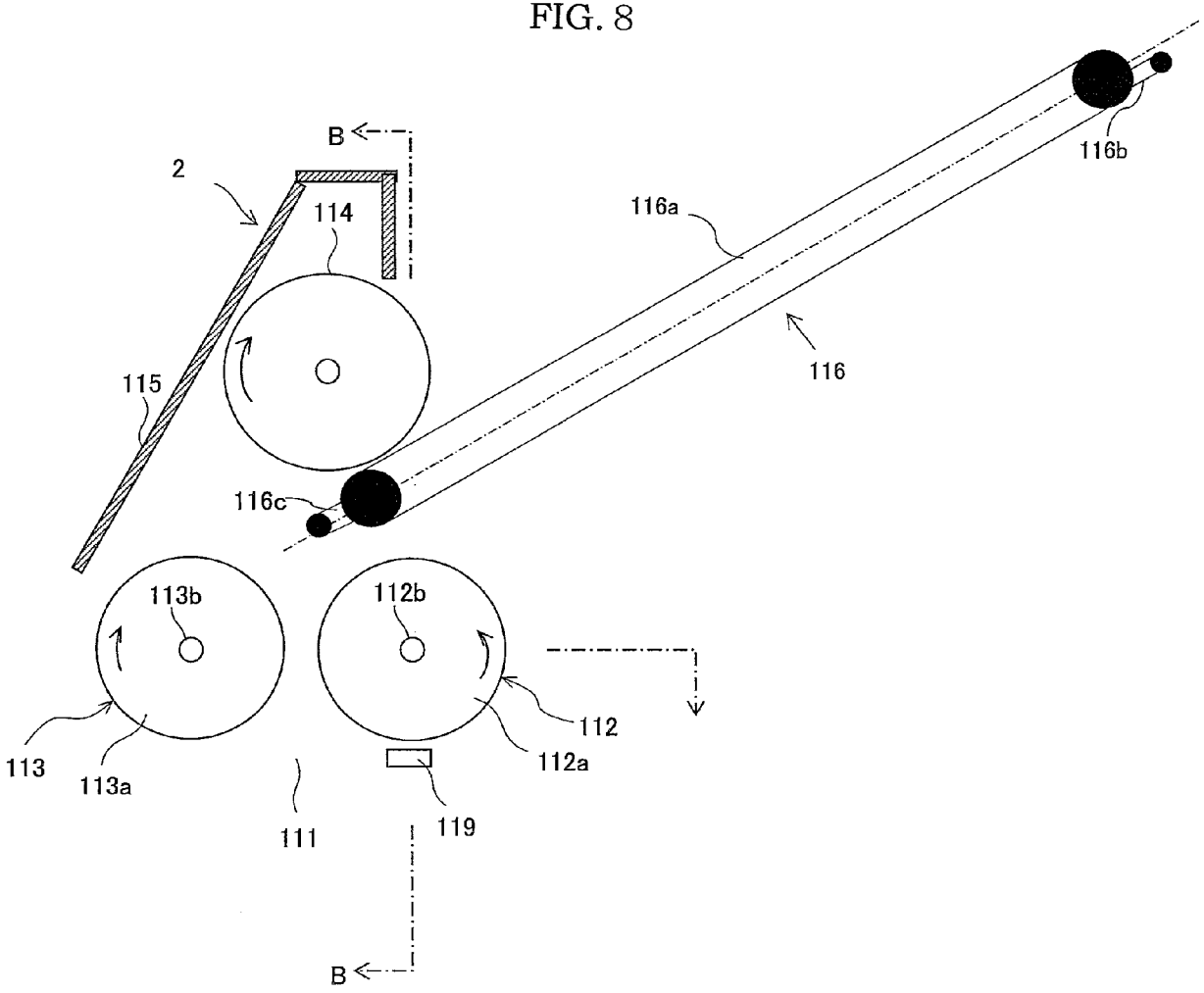
FIG. 8 is an explanatory view of a general construction of the developing device according to Embodiment 1.

As illustrated in FIGS. 4 and 8, the doctor member (layer thickness-regulating member) 116 is disposed in such a way as to come close to the surface of the developing roller 114. The doctor member 116 is a cylindrical member extending parallel to an axis line of the developing roller 114 and is fixedly supported by the developer tank 111 in such a way as to be opposed to an outer periphery of the developing roller 114 and to be spaced at a predetermined gap from the outer periphery, and the doctor member regulates a layer thickness of the developer retained in layer on the outer periphery of the developing roller 114.

The doctor member 116 may be made of stainless steel but may be made of an aluminum alloy, a synthetic resin, or the like.

The doctor member 116 comprises a body part 116*a* provided along the axis line of the developing roller 114 and regulating the layer thickness of the developer retained in layer on the outer periphery of the developing roller 114; a first supporting part 116*b* having a diameter smaller than that of the body part 116*a* and provided at one end of the body part 116*a* to project from the body part 116*a* and parallel to the body part so as to support the body part 116*a* at the one end; and a second supporting part 116*c* having a diameter smaller than that of the body part 116*a* and provided at the other end of the body part 116*a* to coaxially project from the body part 116*a* so as to support the body part 116*a* at the other end.

The body part 116*a* is configured to have the same diameter throughout its entire length. The first supporting part 116*b* and the second supporting part 116*c* of the doctor member 116 are fixedly supported by one end wall and the other end wall of the developer tank 111, respectively.

A central axis of the first supporting part 116*b* of the doctor member 116 is configured to be eccentric to a central axis of the body part 116*a* at a predetermined eccentricity ratio. This predetermined eccentricity ratio means a predetermined value of an extent to which the central axis of the first supporting part 116*b* is eccentric to the central axis of the body part 116*a*.

Since the central axis of the first supporting part 116*b* is eccentric to the central axis of the body part 116*a* at the predetermined eccentricity ratio, the body part 116*a* tentatively supported by the first supporting part 116*b* and the second supporting part 116*c* is appropriately rotated and adjusted by a person (who assembles the developing device) to obtain a predetermined gap—a gap for uniformly developing an image along the axis line of the developing roller 114 and for stably obtaining the image with a uniform concentration—before the doctor member 116 is fixedly supported by the developer tank 111.

As illustrated in FIGS. 4 and 6, the toner refill-detecting sensor 119 is mounted on the developer tank 111 and in the vicinity of the toner refill port 115*a*. The toner refill-detecting sensor 119 is disposed on the downstream side of a developer-conveying direction (indicated by the arrow X) and on a bottom of the developer tank 111, namely, on the underside of the first conveying member 112. The bottom of the developer tank 111 means a bottom of the first conveying path P.

A sensing surface of the toner refill-detecting sensor 119 is disposed to be exposed inward. Also, the toner refill-detecting sensor 119 is electrically connected to a toner concentration-controlling means (not illustrated). Used as the toner refill-detecting sensor 119 is a commonly-used toner refill-detecting sensor such as a transmitted light-detecting sensor, a reflected light-detecting sensor, or a magnetic permeability-detecting sensor. Among these sensors, the magnetic permeability-detecting sensor is preferable.

The magnetic permeability-detecting sensor is connected to a power source (not illustrated). A drive voltage for driving the magnetic permeability-detecting sensor and a control voltage for outputting a detection result of a toner concentration to a control means are applied to the magnetic permeability-detecting sensor from the power source.

The application of the voltage from the power source to the magnetic permeability-detecting sensor is controlled by the control means.

The magnetic permeability-detecting sensor is to output the detection result of the toner concentration as an output voltage value on the basis of the application of the control voltage, and the magnetic permeability-detecting sensor is basically excellent in sensitivity to the output voltage near a middle value and thus uses the control voltage to obtain the output voltage close to the middle value.

This type of the magnetic permeability-detecting sensor is commercially available such as TS-L, TS-A, or TS-K (all of these are trade names, and these sensors are manufactured by TDK Corporation).

In the following, it will be explained how the developer in the developer tank 111 of the developing device 2 is conveyed, with reference to FIGS. 2 to 7. A toner contained in the toner refill device 22 is transported to the developer tank 111 through the toner transport mechanism 102 and the toner refill port 115*a* so as to refill the developer tank 111.

In the developer tank 111, the first conveying member 112 and the second conveying member 113 are driven by the driving means (not illustrated) such as motors, respectively, so as to rotate and convey the developer. More specifically, the developer in the first conveying path P is conveyed in the direction X by the first conveying member 112 while being stirred and arrives at the first communicating path a. The developer arrived at the first communicating path a is conveyed to the second conveying path Q through the first communicating path a.

The developer in the second conveying path Q is conveyed in the direction Y by the second conveying member 113 while being stirred and arrives at the second communicating path b. The developer arrived at the second communicating path b is conveyed to the first conveying path P through the second communicating path b. The first conveying member 112 and the second conveying member 113, namely, convey the developer in the opposite directions while stirring the developer.

As described above, the developer in the developer tank 111 circulates through the first conveying path P, the first communicating path a, the second conveying path Q, and the second communicating path b in order of the first conveying path P→the first communicating path a→the second conveying path Q→the second communicating path b.

While being conveyed through the second conveying path Q, the developer is drawn up by the rotating developing roller 114 and is retained in layer on the surface (outer periphery) of the developing roller 114; and the toner included in the developer is transported to the photoconductive drum 3 and is consumed in sequence.

To refill the developer tank with an unused toner in an amount of the consumed toner, the unused toner is supplied to the first conveying path P through the toner refill port 115*a*. The supplied toner is mixed and stirred with the developer that is already present in the first conveying path P.

As illustrated in FIG. 8, the developer is drawn up by the rotating developing roller 114 to be retained in layer on the outer periphery of the developing roller; and a layer thickness of the developer is regulated by the body part 116*a* of the doctor member 116.

The doctor member 116 is formed in such a way that the body part 116*a* is 220 mm in length and 5 mm in diameter (which is configured to be the same throughout an entire length of the body part 116*a*), the first supporting part 116*b* is 3 mm in length and 2 mm in diameter, and the second supporting part 116*c* is 3 mm in length and 2.5 mm in diameter. The central axis of the first supporting part 116*b* is configured to be eccentric to the central axis of the body part 116*a* at a predetermined eccentricity ratio of 3/100.

As described above, the doctor member 116 is fixedly supported by the developer tank 111 at the both end walls of the developer tank 111 in such a way as to be opposed to the outer periphery of the developing roller 114 and to be spaced at a predetermined gap from the outer periphery, while the central axis of the first supporting part 116*b* is configured to be eccentric to the central axis of the body part 116*a* at the predetermined eccentricity ratio of 3/100.

Therefore, the body part 116*a* tentatively supported by the first supporting part 116*b* and the second supporting part 116*c* is appropriately rotated and adjusted by a person before the doctor member is fixedly supported by the developer tank so that the gap between the body part 116*a* of the doctor member 116 and the outer periphery of the developing roller 114 is measured at a certain position with use of a gap-measuring instrument such as a gap gauge every time the body part is rotated and adjusted, to obtain the above-described predetermined gap.

Embodiment 2

Figure 9:
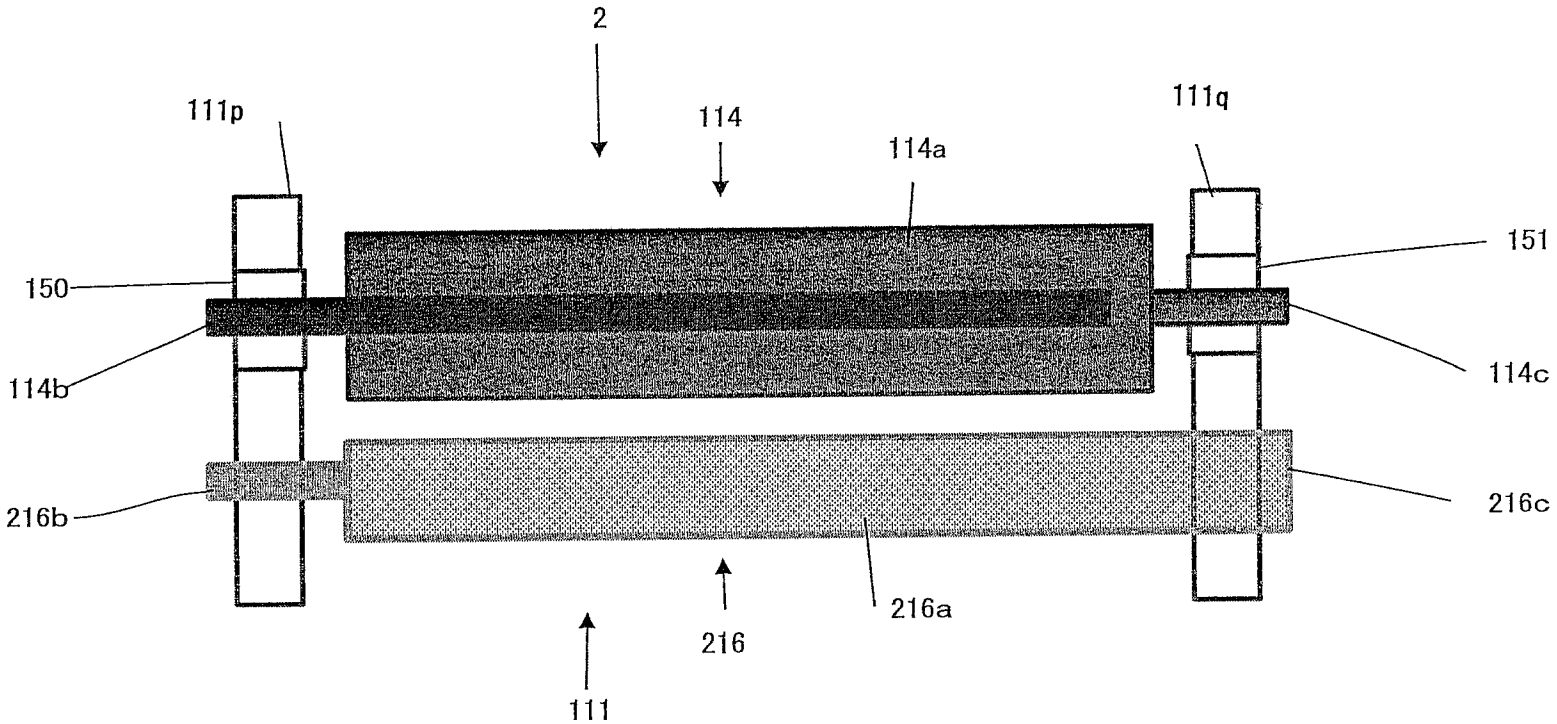
FIG. 9 is an explanatory view of a frontal structure of a developing device according to Embodiment 2.
Figure 10:
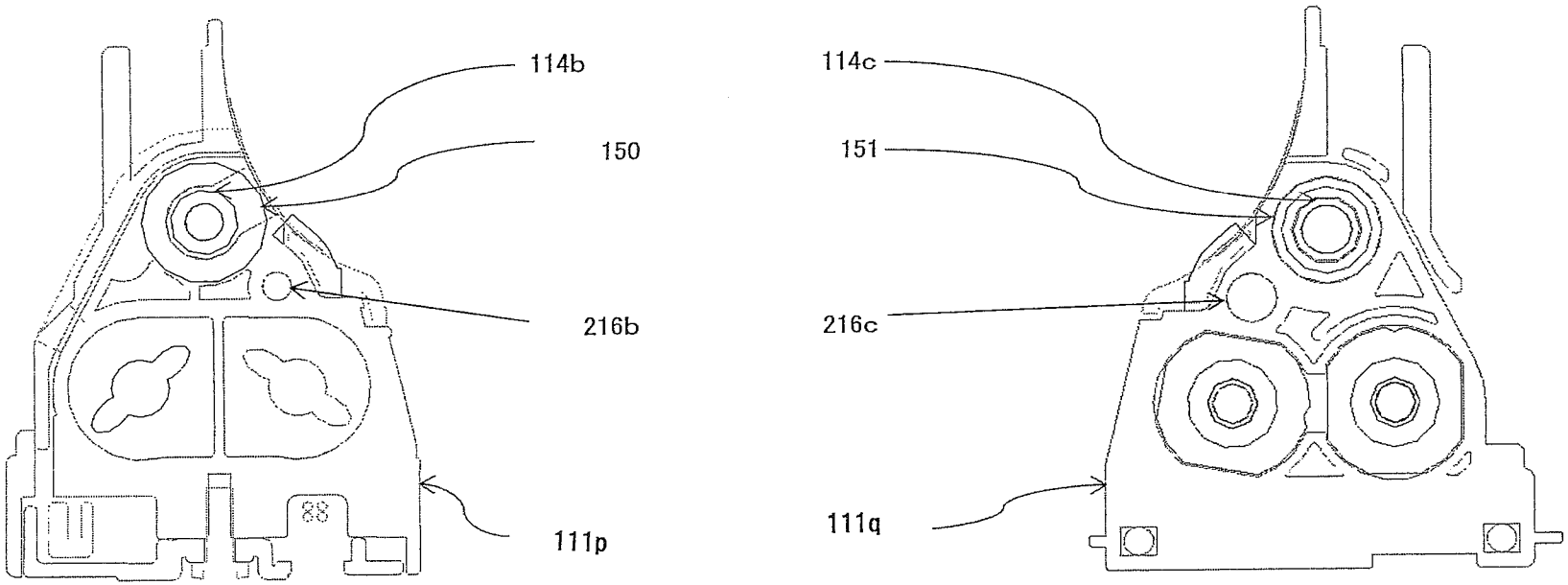
FIG. 10 is explanatory views of an end structure of the developing device according to Embodiment 2.

FIG. 9 is an explanatory view of a frontal structure of a developing device according to Embodiment 2 of this invention. FIG. 10 is explanatory views of an end structure of the developing device according to Embodiment 2.

As illustrated in FIGS. 9 and 10, a developing device 2 according to Embodiment 2 comprises the developing roller 114 and a doctor member 216. The developing roller 114 in Embodiment 2 is the same as the developing roller in the developing device 2 of Embodiment 1.

The developing roller 114 comprises a body part 114*a* for drawing up a developer in the developer tank 111 and for retaining the developer on its surface; a roller-fixing shaft 114*b* provided at one end of the body part 114*a* to fix the body part 114*a* on a holder 150 mounted on one end wall 111*p* of the developer tank 111; and a roller-driving shaft 114*c* provided at the other end of the body part 114*a* to rotate and drive the body part 114*a* supported by a bearing 151 mounted on the other end wall 111*q* of the developer tank 111.

The doctor member (layer thickness-regulating member) 216 is a cylindrical member extending parallel to the axis line of the developing roller 114 and is fixedly supported by the both end walls 111*p* and 111*q* in such a way as to be opposed to the outer periphery of the developing roller 114 and to be spaced at a predetermined gap from the outer periphery, and the doctor member regulates a layer thickness of the developer retained in layer on the outer periphery of the developing roller 114.

That is, the doctor member 216 comprises a body part 216*a* provided along the axis line of the developing roller 114 and regulating the layer thickness of the developer retained in layer on an outer periphery of the body part 114*a* of the developing roller 114; a first supporting part 216*b* having a diameter smaller than that of the body part 216*a* and provided at one end of the body part 216*a* to project from the body part 216*a* and parallel to the body part so as to support the body part 216*a* at the one end; and a second supporting part 216*c* having the same diameter as that of the body part 216*a* and provided at the other end of the body part 216*a* to coaxially project from the body part 216*a* so as to support the body part 216*a* at the other end.

The first supporting part 216*b* and the second supporting part 216*c* of the doctor member 216 are fixedly supported by the end walls 111*p* and 111*q* of the developer tank 111, respectively.

As illustrated in FIGS. 9 and 10, the developer is drawn up by the rotating developing roller 114 to be retained in layer on the outer periphery of the body part 114*a*; and the layer thickness of the developer is regulated by the body part 216*a* of the doctor member 216.

The doctor member 216 is formed in such a way that the body part 216*a* is 240 mm in length and 5.0 mm in diameter (which is configured to be the same throughout an entire length of the body part 216*a*), the first supporting part 216*b* is 30 mm in length and 3.0 mm in diameter, and the second supporting part 216*c* is 30 mm in length and 5.0 mm in diameter. A central axis of the first supporting part 216*b* is configured to be eccentric to a central axis of the body part 216*a* at a predetermined eccentricity ratio of 5/100.

As described above, this doctor member 216 is fixedly supported by the both end walls 111*p* and 111*q* of the developer tank 111 in such a way as to be opposed to the developing roller 114 and to be spaced at a predetermined gap between the outer periphery of the body part 114*a* and the body part 216*a* of the doctor member 216, while the central axis of the first supporting part 216*b* is configured to be eccentric to the central axis of the body part 216*a* at the predetermined eccentricity ratio of 5/100.

Figure 11:
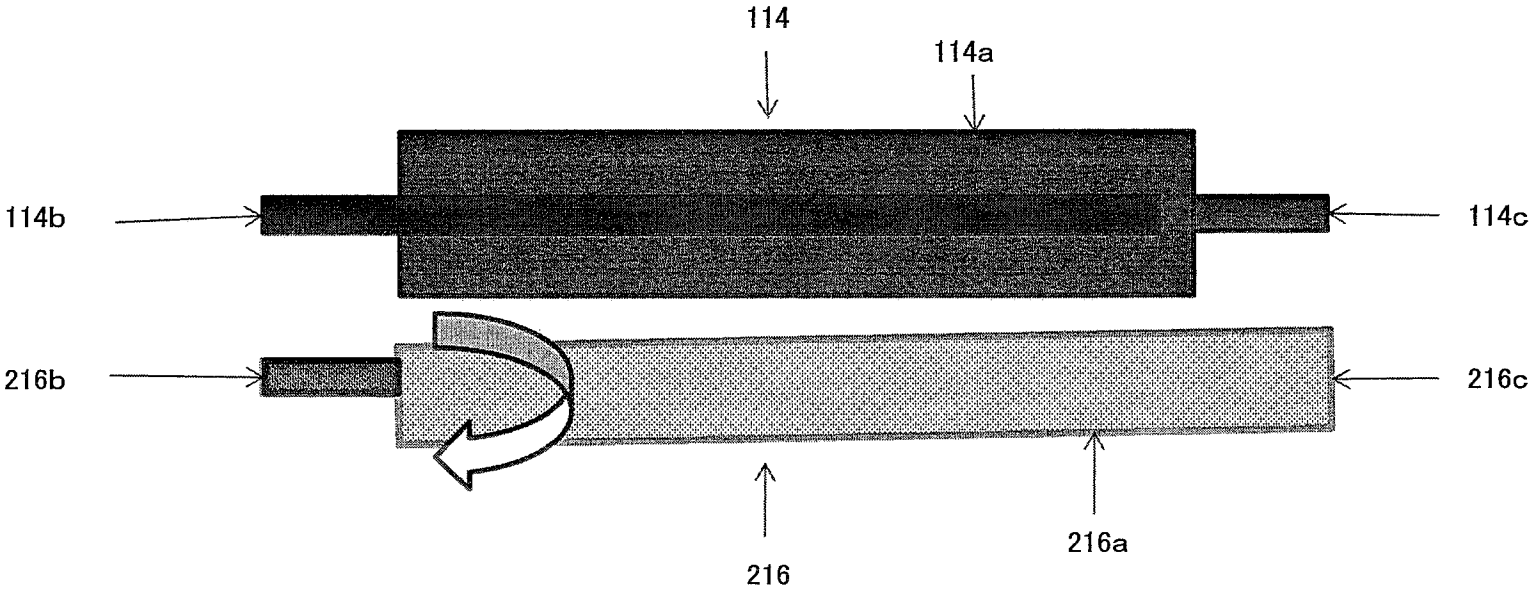
FIG. 11 is an explanatory view of a structure of a layer thickness-regulating member that is not yet fixedly supported on the developing device according to Embodiment 2.

Thus, the body part 216*a* tentatively supported by the first supporting part 216*b* and the second supporting part 216*c* is appropriately rotated and adjusted by a person (see an arrow indicated in FIG. 11) before the doctor member 216 is fixedly supported.

Figure 12:
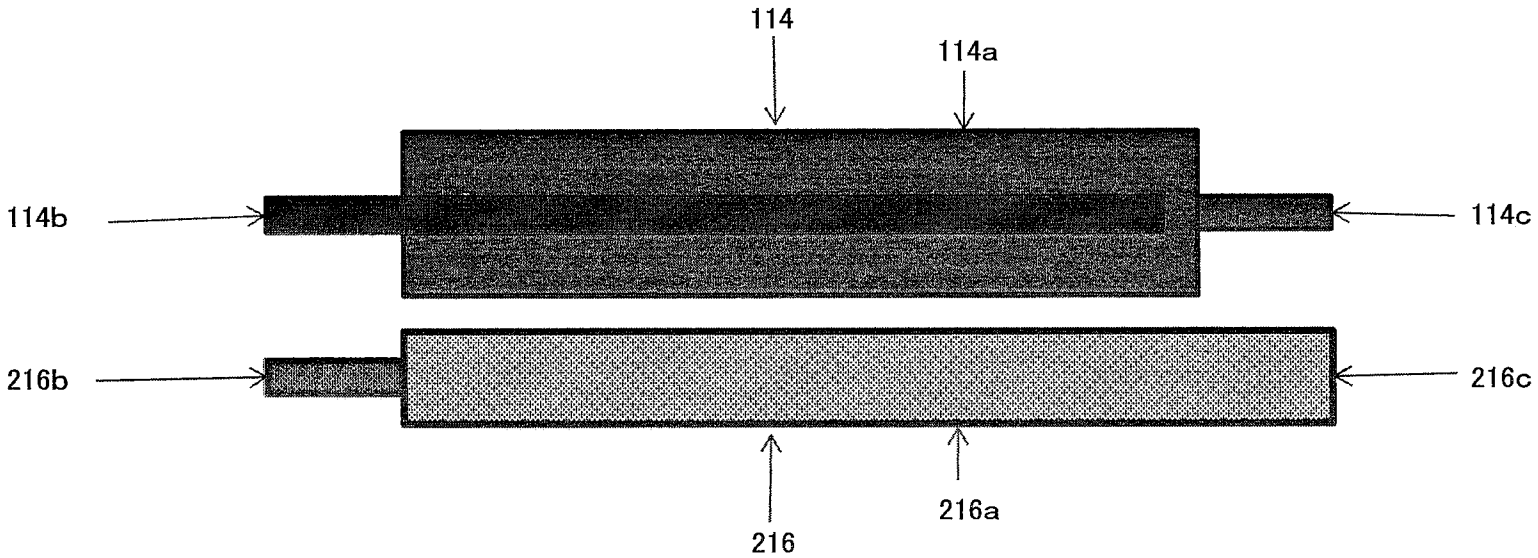
FIG. 12 is an explanatory view of a structure of the layer thickness-regulating member that is already supported fixedly on the developing device according to Embodiment 2.

The gap between the body part 216*a* of the doctor member 216 and the outer periphery of the developing roller 114*a* of the developing roller 114 is measured at a certain position with use of a gap-measuring instrument such as a gap gauge every time the body part is rotated and adjusted, to obtain the above-described predetermined gap (see FIG. 12).

Embodiment 3

Figure 13:
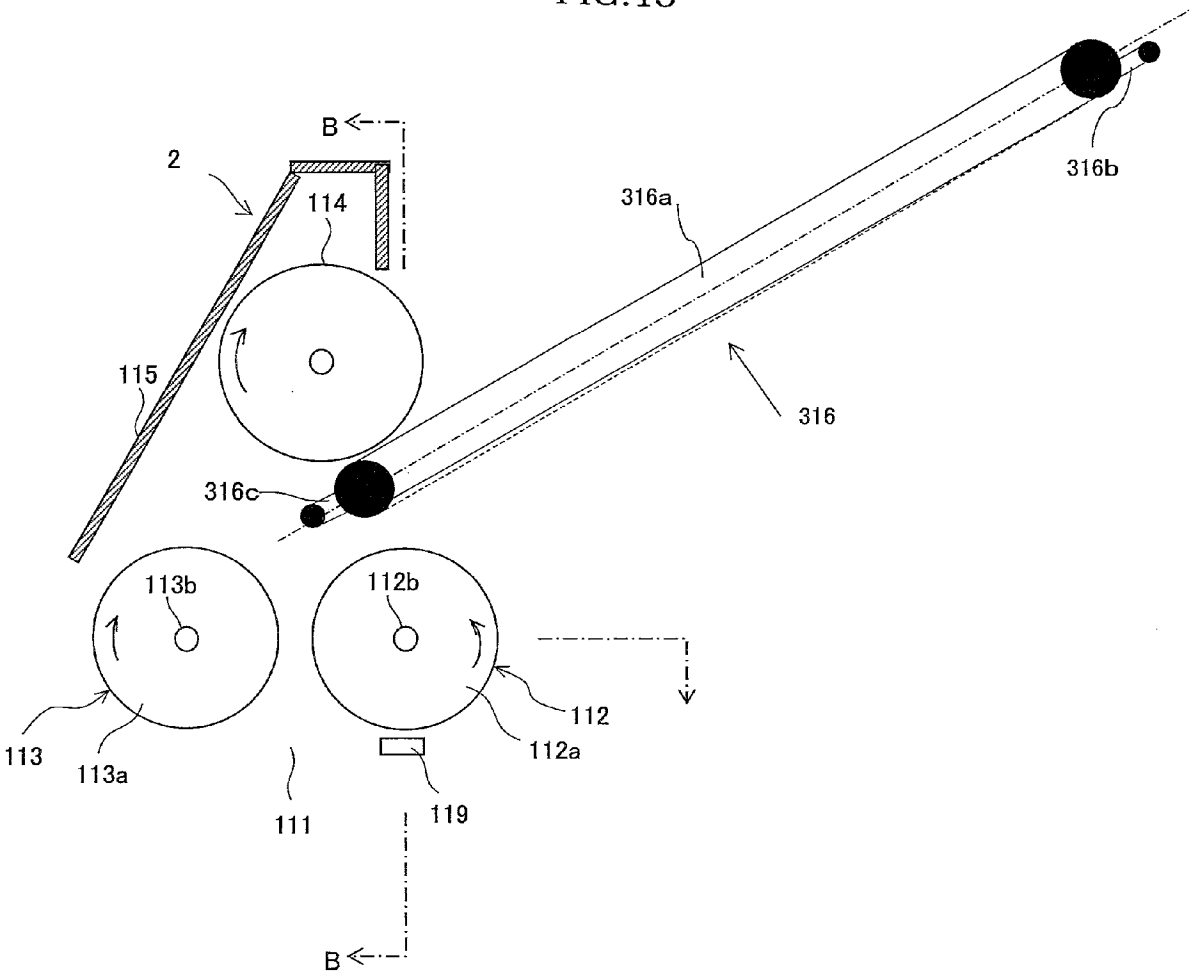
FIG. 13 is an explanatory view of a general construction of a developing device according to Embodiment 3 of this invention.

FIG. 13 is an explanatory view of a general construction of a developing device according to Embodiment 3 of this invention.

As illustrated in FIG. 13, a doctor member (layer thickness-regulating member) 316 is disposed in such a way as to come close to the surface of the developing roller 114. The doctor member 316 is a cylindrical member extending parallel to the axis line of the developing roller 114 and is fixedly supported by the developer tank 111 in such a way as to be opposed to the outer periphery of the developing roller 114 and to be spaced at a predetermined gap from the outer periphery, and the doctor member regulates a layer thickness of a developer retained in layer on the outer periphery of the developing roller 114.

The doctor member 316 comprises a body part 316*a* provided along the axis line of the developing roller 114 and regulating the layer thickness of the developer retained in layer on the outer periphery of the developing roller 114; a first supporting part 316*b* having a diameter smaller than that of the body part 316*a* and provided at one end of the body part 316*a* to project from the body part 316*a* and parallel to the body part 316*a* so as to support the body part 316*a* at the one end; and a second supporting part 316*c* having a diameter smaller than that of the body part 316*a* and provided at the other end of the body part 316*a* to coaxially project from the body part 316*a* so as to support the body part 316*a* at the other end.

The body part 316*a* is formed in such a way as to be conically tapered from the one end to the other end. This conical taper is formed in such a way that the body part 316*a* has an outside diameter as 97 length unit at the one end with respect to an outside diameter as 100 length unit at the other end.

The first supporting part 316*b* and the second supporting part 316*c* of the doctor member 316 are fixedly supported by the one end wall and the other end wall of the developer tank 111, respectively.

A central axis of the first supporting part 316*b* of the doctor member 316 is configured to be eccentric to a central axis of the body part 316*a* at a predetermined eccentricity ratio of 4/100. This predetermined eccentricity ratio of 4/100 indicates that the central axis of the first supporting part 316*b* is eccentric to the central axis of the body part 316*a* by 4%.

Since the central axis of the first supporting part 316*b* is eccentric to the central axis of the body part 316*a* at the predetermined eccentricity ratio of 4/100, the body part 316*a* tentatively supported by the first supporting part 316*b* and the second supporting part 316*c* is appropriately rotated and adjusted by a person to obtain a predetermined gap—a gap for uniformly developing an image along the axis line of the developing roller 114 and for stably obtaining the image with a uniform concentration—before the doctor member 316 is fixedly supported by the developer tank 111.

Moreover, since the body part 316*a* is configured to be tapered from the one end to the other end, the body part 316*a* is capable of adjusting the gap between the body part 316*a* and the outer periphery of the developing roller 114 throughout an entire length of the body part 316*a* more finely than the body part having the same outside diameter throughout its entire length.

Embodiment 4

Figure 14:
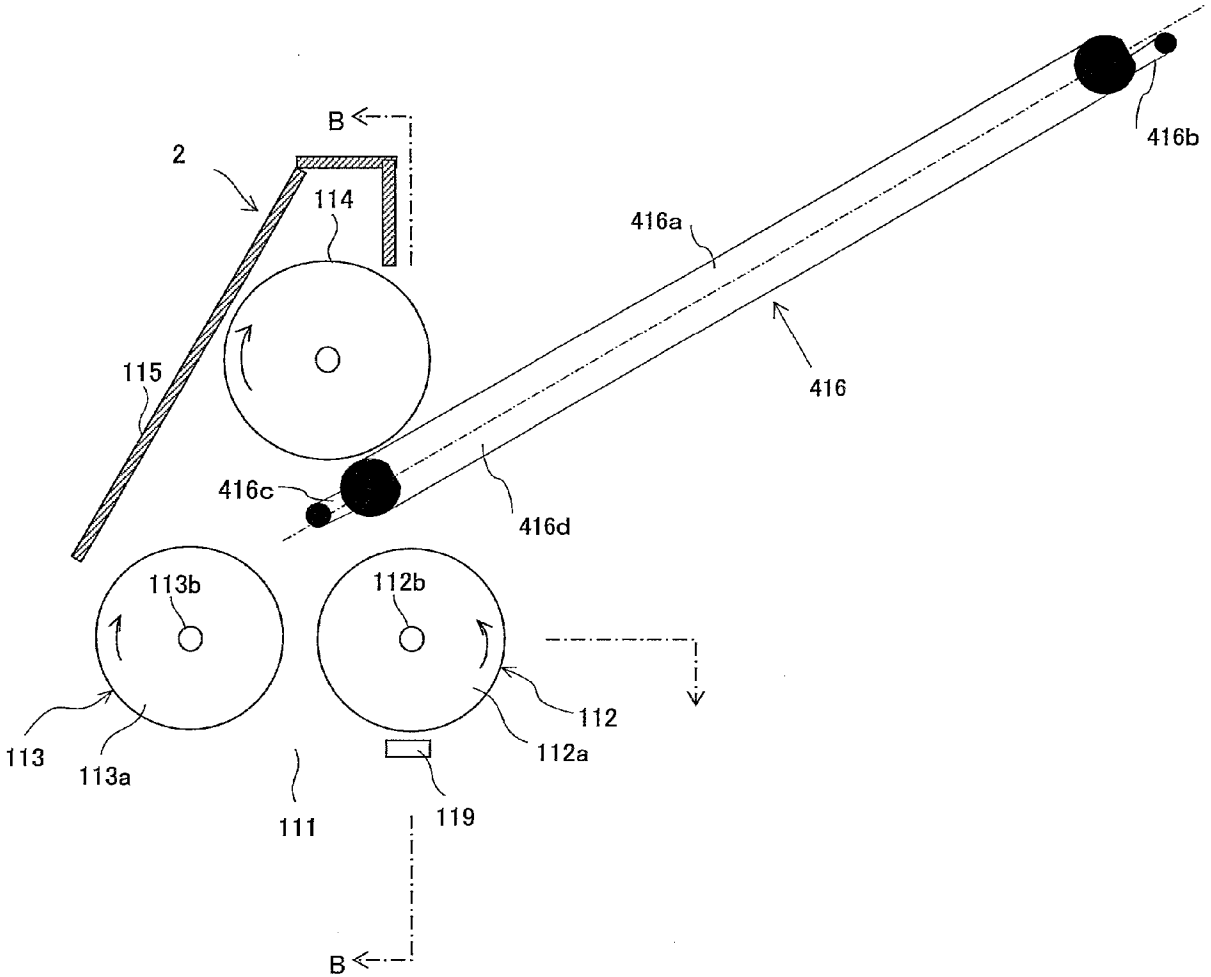
FIG. 14 is an explanatory view of a general construction of a developing device according to Embodiment 4 of this invention.

FIG. 14 is an explanatory view of a general construction of a developing device according to Embodiment 4 of this invention.

As illustrated in FIG. 14, a doctor member (layer thickness-regulating member) 416 is disposed in such a way as to come close to the surface of the developing roller 114.

The doctor member 416 is a cylindrical member extending parallel to the axis line of the developing roller 114 and is fixedly supported by the developer tank 111 in such a way as to be opposed to the outer periphery of the developing roller 114 and to be spaced at a predetermined gap from the outer periphery, and the doctor member regulates a layer thickness of a developer retained in layer on the outer periphery of the developing roller 114.

The doctor member 416 comprises a body part 416*a* provided along the axis line of the developing roller 114 and regulating the layer thickness of the developer retained in layer on the outer periphery of the developing roller 114; a first supporting part 416*b* having a diameter smaller than that of the body part 416*a* and provided at one end of the body part 416*a* to project from the body part 416*a* and parallel to the body part 416*a* so as to support the body part 416*a* at the one end; and a second supporting part 416*c* having a diameter smaller than that of the body part 416*a* and provided at another end of the body part 416*a* to coaxially project from the body part 416*a* so as to support the body part 416*a* at the other end.

The body part 416*a* has a flat surface portion 416*d* formed on its outer periphery, and the flat surface portion has a rectangular shape in plan configuration extending throughout an entire length of the body part 416*a* in a longitudinal direction. The flat surface portion 416*d* is formed by processing the outer periphery of the body part 416*a* whose outside diameter is 5 mm in such a way that a thickness of only 0.1 mm is cut off from the outer periphery throughout the entire length of the body part 416*a*.

Figure 15:
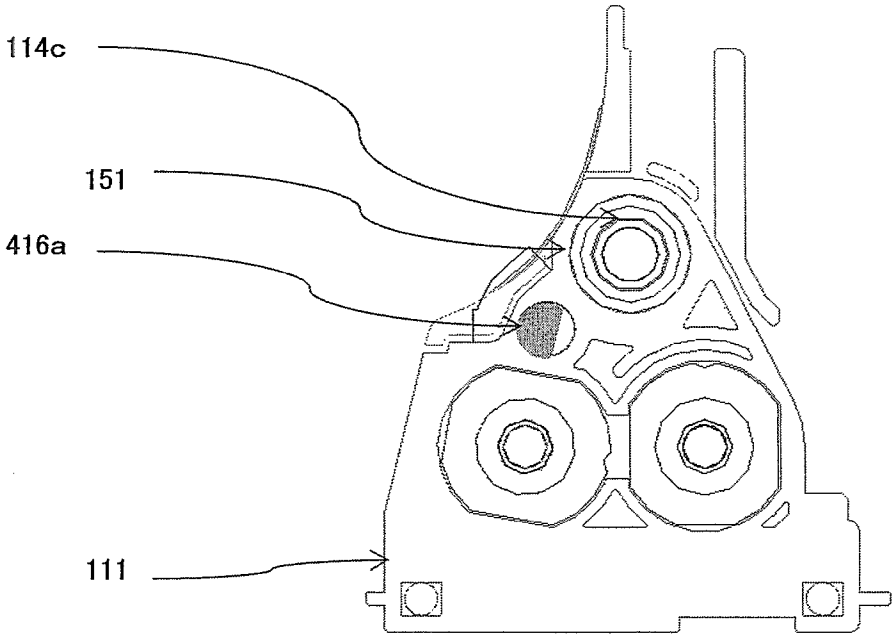
FIG. 15 is an explanatory view of an end structure of the developing device according to Embodiment 4.

As illustrated in FIG. 15, a cross-section surface of this body part 416*a* having the flat surface portion 416*d* has the shape like the letter D throughout the entire length of the body part 416*a*.

The first supporting part 416*b* and the second supporting part 416*c* of the doctor member 416 are fixedly supported by the one end wall and the other end wall of the developer tank 111, respectively.

A central axis of the first supporting part 416*b* of the doctor member 416 is configured to be eccentric to a central axis of the body part 416*a* at a predetermined eccentricity ratio of 6/100. This predetermined eccentricity ratio of 6/100 indicates that the central axis of the first supporting part 416*b* is eccentric to the central axis of the body part 416*a* by 6%.

Since the central axis of the first supporting part 416*b* is eccentric to the central axis of the body part 416*a* at the predetermined eccentricity ratio of 6/100, the body part 416*a* tentatively supported by the first supporting part 416*b* and the second supporting part 416*c* is appropriately rotated and adjusted by a person to obtain a predetermined gap—a gap for uniformly developing an image along the axis line of the developing roller 114 and for stably obtaining the image with a uniform concentration—before the doctor member 416 is fixedly supported by the developer tank 111.

Moreover, since the body part 416*a* has the flat surface portion 416*d* formed throughout its entire length, thus the cross-section surface of the body part 416*a* has the shape like the letter D, the body part 416*a* is capable of adjusting the gap between the body part 416*a* and the outer periphery of the developing roller 114 throughout the entire length of the body part 416*a* more finely than the body part having the same outside diameter throughout its entire length.

Embodiment 5

A developing device according to Embodiment 5 of this invention has basically the same construction as that of the developing device 2 according to Embodiment 1 illustrated in FIGS. 4 to 8. For reasons of expediency, FIGS. 4 to 8 illustrating the developing device 2 according to Embodiment 1 will be applied to the developing device according to Embodiment 5; and the reference numerals of the components used for the developing device 2 according to Embodiment 1 are used for the developing device according to Embodiment 5.

An only one difference in construction between the developing device 2 according to Embodiment 1 and the developing device 2 according to Embodiment 5 is that the doctor member 116 used for the former is made of the material such as stainless steel or an aluminum alloy, and a surface of the doctor member is not subjected to any particular treatment, whereas the doctor member 116 used for the developing device 2 of the latter is made of a material such as stainless steel or an aluminum alloy, and a surface of the doctor member is subjected to a blasting treatment. Other constructions (such as materials, structures, and sizes) according to Embodiment 5 are the same as those according to Embodiment 1.

An entire outer periphery of the body part 116*a* of the doctor member 116 of the developing device 2 according to Embodiment 5 is, namely, subjected to a sand-blasting treatment or a bead-blasting treatment.

Its purpose is to give desired surface roughness to the entire outer periphery of the body part 116*a* of the cylindrical doctor member 116. That is, the roughened body part 116*a* of the doctor member 116 for regulating the layer thickness of the developer retained in layer on the outer periphery of the developing roller 114 adjusts friction resistance of the body part to a desired level in order to make the regulated layer thickness of the developer much more uniform and to inhibit a problem—known as "slip conveyance"—such that some of the developer on a surface of the body part 116*a* is not conveyed thoroughly, with the result that conveyance capability of the developer is improved.

Used as a polishing material to be ejected with compressed air during the sand-blasting treatment or the bead-blasting treatment is quartz sand, alumina (aluminum oxide), glass beads, or the like having a suitable grain diameter; and the polishing material is appropriately selected as desired. The surface roughness of the body part 116*a* to be roughened is adjusted in such a way as to be of the order of, for example, 50 to 100 micrometer in consideration of a desired level of the friction resistance. In this case, various blast treatment conditions (a material of the doctor member 116, a peripheral total surface area of the body part 116*a*, a type or a performance of a compressor used for ejecting the compressed air, a type or an average grain diameter of the polishing material, etc.) are appropriately selected.

The preferred embodiments of this invention include combinations of any of the above-described embodiments. This invention may have a variety of varied examples besides the above-described embodiments. These varied examples should not be excluded from the scope of this invention. This invention should include the scope of claims and all varied examples comparable to those in claims and within the claims.

What is claimed is:

1. A developing device comprising:

a developer tank containing a developer;

a developing roller disposed in the developer tank in such a way as to be opposed to a photoconductive drum, the developing roller retaining the developer on its outer periphery and supplying a toner included in the developer to a surface of the photoconductive drum; and a cylindrical layer thickness-regulating member fixedly supported by the developer tank in such a way as to be opposed to the outer periphery of the developing roller and to be spaced at a predetermined gap from the outer periphery and regulating a layer thickness of the developer in the form of a layer retained on the outer periphery of the developing roller, wherein the layer thickness-regulating member comprises:

a body part provided along an axis line of the developing roller and regulating the layer thickness;

a first supporting part having a diameter smaller than that of the body part and provided at one end of the body part to project from the body part and parallel to the body part so as to support the body part at the one end; and a second supporting part having a diameter smaller than or the same as that of the body part and provided at the other end of the body part to project from the body part and parallel to the body part so as to support the body part at the other end, wherein the first supporting part of the layer thickness-regulating member is provided such that a central axis of the first supporting part is configured to be eccentric to a central axis of the body part at a predetermined eccentricity ratio and that the body part tentatively supported by the first supporting part and the second supporting part is appropriately rotated and adjusted by a person to obtain the predetermined gap before the layer thickness-regulating member is fixedly supported by the developer tank.

2. The developing device according to claim 1, wherein the body part of the layer thickness-regulating member is formed in such a way as to have the same outside diameter throughout its entire length.

3. An image forming apparatus comprising:

a photoconductive drum forming an electrostatic latent image on its surface;

a charger charging the surface of the photoconductive drum;

an exposure device forming the electrostatic latent image on the surface of the photoconductive drum;

a developing device supplying a toner to the electrostatic latent image on the photoconductive drum to form a toner image;

a toner refill device refilling the developing device with a toner;

a transfer device transferring the toner image on the photoconductive drum onto a recording medium; and a fusing device fusing the toner image on the recording medium, wherein said developing device is the developing device according to claim 2.

4. The developing device according to claim 1, wherein the body part of the layer thickness-regulating member is formed in such a way as to be conically tapered from the one end to the other end of the body part.

5. An image forming apparatus comprising:

a photoconductive drum forming an electrostatic latent image on its surface;

a charger charging the surface of the photoconductive drum;

an exposure device forming the electrostatic latent image on the surface of the photoconductive drum;

a developing device supplying a toner to the electrostatic latent image on the photoconductive drum to form a toner image;

a toner refill device refilling the developing device with a toner;

a transfer device transferring the toner image on the photoconductive drum onto a recording medium; and a fusing device fusing the toner image on the recording medium, wherein said developing device is the developing device according to claim 4.

6. The developing device according to claim 1, wherein the body part of the layer thickness-regulating member has a flat surface portion formed on its outer periphery; and the flat surface portion has a rectangular shape in plan configuration extending throughout an entire length of the body part in a longitudinal direction.

7. An image forming apparatus comprising:

a photoconductive drum forming an electrostatic latent image on its surface;

a charger charging the surface of the photoconductive drum;

an exposure device forming the electrostatic latent image on the surface of the photoconductive drum;

a developing device supplying a toner to the electrostatic latent image on the photoconductive drum to form a toner image;

a toner refill device refilling the developing device with a toner;

a transfer device transferring the toner image on the photoconductive drum onto a recording medium; and a fusing device fusing the toner image on the recording medium, wherein said developing device is the developing device according to claim 6.

8. The developing device according to claim 1, wherein an entire outer periphery of the body part of the layer thickness-regulating member is subjected to a blasting treatment.

9. An image forming apparatus comprising:

a photoconductive drum forming an electrostatic latent image on its surface;

a charger charging the surface of the photoconductive drum;

an exposure device forming the electrostatic latent image on the surface of the photoconductive drum;

a developing device supplying a toner to the electrostatic latent image on the photoconductive drum to form a toner image;

a toner refill device refilling the developing device with a toner;

a transfer device transferring the toner image on the photoconductive drum onto a recording medium; and a fusing device fusing the toner image on the recording medium, wherein said developing device is the developing device according to claim 8.

10. The developing device according to claim 1, wherein the predetermined gap is a gap capable of uniformly developing an image along an axis line of the developing roller and of stably obtaining the image with a uniform concentration.

11. An image forming apparatus comprising:

a photoconductive drum forming an electrostatic latent image on its surface;

a charger charging the surface of the photoconductive drum;

an exposure device forming the electrostatic latent image on the surface of the photoconductive drum;

a developing device supplying a toner to the electrostatic latent image on the photoconductive drum to form a toner image;

a toner refill device refilling the developing device with a toner;

a transfer device transferring the toner image on the photoconductive drum onto a recording medium; and a fusing device fusing the toner image on the recording medium, wherein said developing device is the developing device according to claim 10.

12. The developing device according to claim 1, wherein the eccentricity ratio ranges from 2/100 to 10/100.

13. An image forming apparatus comprising:

a photoconductive drum forming an electrostatic latent image on its surface;

a charger charging the surface of the photoconductive drum;

an exposure device forming the electrostatic latent image on the surface of the photoconductive drum;

a developing device supplying a toner to the electrostatic latent image on the photoconductive drum to form a toner image;

a toner refill device refilling the developing device with a toner;

a transfer device transferring the toner image on the photoconductive drum onto a recording medium; and a fusing device fusing the toner image on the recording medium, wherein said developing device is the developing device according to claim 12.

14. The developing device according to claim 1, wherein the second supporting part of the layer thickness-regulating member has a diameter smaller than that of the body part and is provided coaxially with the body part.

15. An image forming apparatus comprising:

a photoconductive drum forming an electrostatic latent image on its surface;

a charger charging the surface of the photoconductive drum;

an exposure device forming the electrostatic latent image on the surface of the photoconductive drum;

a developing device supplying a toner to the electrostatic latent image on the photoconductive drum to form a toner image;

a toner refill device refilling the developing device with a toner;

a transfer device transferring the toner image on the photoconductive drum onto a recording medium; and a fusing device fusing the toner image on the recording medium, wherein said developing device is the developing device according to claim 14.

16. The developing device according to claim 1, wherein the second supporting part of the layer thickness-regulating member has the same diameter as that of the body part and is provided coaxially with the body part.

17. An image forming apparatus comprising:

a photoconductive drum forming an electrostatic latent image on its surface;

a charger charging the surface of the photoconductive drum;

an exposure device forming the electrostatic latent image on the surface of the photoconductive drum;

a developing device supplying a toner to the electrostatic latent image on the photoconductive drum to form a toner image;

a toner refill device refilling the developing device with a toner;

a transfer device transferring the toner image on the photoconductive drum onto a recording medium; and a fusing device fusing the toner image on the recording medium, wherein said developing device is the developing device according to claim 16.

18. An image forming apparatus comprising:

a photoconductive drum forming an electrostatic latent image on its surface;

a charger charging the surface of the photoconductive drum;

an exposure device forming the electrostatic latent image on the surface of the photoconductive drum;

a developing device supplying a toner to the electrostatic latent image on the photoconductive drum to form a toner image;

a toner refill device refilling the developing device with a toner;

a transfer device transferring the toner image on the photoconductive drum onto a recording medium; and a fusing device fusing the toner image on the recording medium, wherein said developing device is the developing device according to claim 1.

* * * * *